United States Patent [19]

Sakashita

[11] Patent Number: 5,051,331

[45] Date of Patent: Sep. 24, 1991

[54] TONER

[75] Inventor: Kiichiro Sakashita, Inagi, Japan

[73] Assignee: Canon Kabushiki Kaisha, Tokyo, Japan

[21] Appl. No.: 458,369

[22] Filed: Dec. 28, 1989

[30] Foreign Application Priority Data

Dec. 29, 1988 [JP] Japan ..... 63-335146
Dec. 8, 1989 [JP] Japan ..... 1-317537

[51] Int. Cl.[5] ..... G03G 9/00; G03G 5/00

[52] U.S. Cl. ..... 430/110; 430/109; 430/137

[58] Field of Search ..... 430/109, 110, 137, 904

[56] References Cited

U.S. PATENT DOCUMENTS 4,481,274 11/1984 Mitsuhashi et al. ..... 430/109
4,565,766 1/1986 Mitsuhashi et al. ..... 430/126
4,597,920 7/1986 Golike ..... 526/348.1 X
4,626,488 12/1986 Inoue ..... 430/109
4,702,986 10/1987 Imai et al. ..... 430/120
4,816,342 3/1989 Farrell et al. ..... 528/475.5
4,943,615 7/1990 Yamawaki ..... 525/240
4,952,477 8/1990 Fuller et al. ..... 430/109

FOREIGN PATENT DOCUMENTS 48-7345 5/1973 Japan .
61-59454 3/1986 Japan .

*Primary Examiner*—Marion E. McCamish
*Assistant Examiner*—S. C. Crossan
*Attorney, Agent, or Firm*—Fitzpatrick, Cella, Harper & Scinto

[57] ABSTRACT

A toner for developing electrostatic latent images includes a binding resin, such as a crosslinked styrene-acrylate ester copolymer, and a low-molecular weight olefin copolymer, the low-molecular weight polyolefin copolymer having at least two olefinic repeating units and having two or more peaks of melting at temperatures between 90° C. and 170° C.

17 Claims, 2 Drawing Sheets

TONER

BACKGROUND OF THE INVENTION

1. Field of the Invention and Related Art

The present invention relates to a novel toner for developing an electrostatic charge image suitable for use in image-forming processes such as electrophotography, electrostatic recording and so forth.

In general, an electrophotographic process employs a photoconductive member of a photoconductive material such as cadmium sulfide, polyvinyl carbazole, selenium, zinc oxide, silicon and the like. Electrostatic images are formed on the photoconductive members by making use of the photoconductivity of such a photoconductive material. A typical electrophotographic process, for example, includes the steps of uniformly charging a photoconductive layer (referred to as "photosensitive member" hereinafter), conducting an image exposure so as to form an electrostatic latent image on the photosensitive member, developing the electrostatic latent image with a toner powder charged in a polarity opposite to or the same as the polarity of the electrostatic latent image, and, as required, transferring the developed image to a transfer sheet. When the process employs the step of transfering the image, any residual toner on the photosensitive member which has not been transferred to the transfer sheet, is removed to clean the photosensitive member so as to enable the photosensitive member to be used repeatedly.

The removal of the residual toner is usually conducted by bringing a cleaning member or means such as a blade, fur brush or a magnetic brush into contact with the photosensitive member In this case, since the cleaning member is pressed onto the photosensitive member at a suitable level of contact pressure, problems such as damaging of the surface of the photosensitive member and deposition of toner on the photosensitive member are often experienced as a result of repeated use of the apparatus. In order to avoid deposing toner on the surface of the photosensitive member, Japanese Patent Application Laid-Open No. 48-7345 discloses an approach in which both a friction-reducing substance and a polishing material are added to a developing agent. This approach, however, suffers from the following disadvantage although it is effective in preventing deposition of toner.

The addition of the friction-reducing substance in an amount sufficient for avoiding deposition of toner makes it difficult to remove substances having low electrical resistance, e.g., paper dust, ozone-containing substances and so forth, which are generated on or attached to the surface of the photosensitive member The presence of such substances of low electrical resistance on the surface of the photosensitive member seriously impairs the quality of the electrostatic latent image on the photosensitive member, particularly when the humidity of the ambient air is high. The amounts of the friction-reducing substance and polishing substance have to be determined carefully, making it difficult to obtain a toner or developing agent which exhibits a stable performance.

Japanese Patent Application Laid-Open No. 61-59454 discloses how to suppress grinding of the photosensitive member by suitably adjusting the coefficient of kinetic friction of the toner. It is suggested that an appreciable effect is obtained by adding polyalkylene to the toner. This method does not employ any other lubricant and, hence, is superior in anti-fogging performance and image density stability. This method, however, still suffers from the following problems.

For example, polyalkylene exhibits only a small compatibility with binding resin, so that polyalkylene cannot be dispersed in the form of sufficiently small segments even through treatments such as heating and kneading. Consequently, it is often experienced that polyalkylene components come off the particles formed by a subsequent pulverizing process The separated polyalkylene exists as free particles among the toner particles and such free particles are charged in a manner different from that of the toner particles, often resulting in degradation of the image such as by fogging. Ordinary processes for preparing a toner employ a step for regulating the particle size. This is usually conducted by classification procedures through which toner particles are classified into fine particles which are too fine to be used, moderate size particles which are usually quite suitable for use and coarse particles. The fine particles are usually obtained in an amount of 10 to 40 wt % of the total weight of the toner particles. The fine particles and coarse particles are returned to the initial step of the toner preparation process so as to be mixed with the starting material for repeated use.

The above-mentioned free particles of polyalkylene are mostly classified into fine particles. This tendency is marked, particularly in magnetic toners, due to difference in specific gravity. Repeated re-use of the fine particles rich in the polyalkylene particles causes a change in the toner composition, making it difficult to obtain a uniform toner having stable developing characteristics.

SUMMARY OF THE INVENTION

The present inventors have found that two keys to the solution of these problems are to enhance the dispersion of a low-molecular olefin polymer or copolymer in a binding resin and to prevent formation of hard segments by the low-molecular olefin polymer or copolymer in the binding resin. The present invention has been achieved through an intense study based upon this knowledge.

An object of the present invention is to provide a toner capable of forming a toner image without producing substantial fogging.

Another object of the present invention is to provide a toner which can constantly form clear toner images with stable image density.

Still another object of the present invention is to provide a toner which is improved to eliminate any fluctuation of image quality even when particles other than moderate size particles formed during classification, i.e., fine and coarse particles, are returned to the initial step of the toner preparation process.

A further object of the present invention is to provide a toner which can suppress damaging and grinding of the surface of a photosensitive member.

A still further object of the present invention is to provide a toner which can prevent degradation of latent images even in an atmosphere having high humidity.

A still further object of the present invention is to provide a toner which can avoid deposition or fusing of the toner onto the surface of a photosensitive member thereby eliminating generation of score or spot contamination of the reproduced image.

A still further object of the present invention is to provide a toner which can prevent contamination of a sleeve of a developing machine so as to prevent reduction of image density during long use.

To this end, according to the present invention, there is provided a toner for developing electrostatic latent images, comprising, at least, a binding resin and a low-molecular olefin copolymer, the low-molecular olefin copolymer comprising at least two olefin monomer units and having two or more peaks of melting at temperatures ranging between 90° C. and 170° C.

DESCRIPTION OF THE PREFERRED EMBODIMENTS

Figure 1:
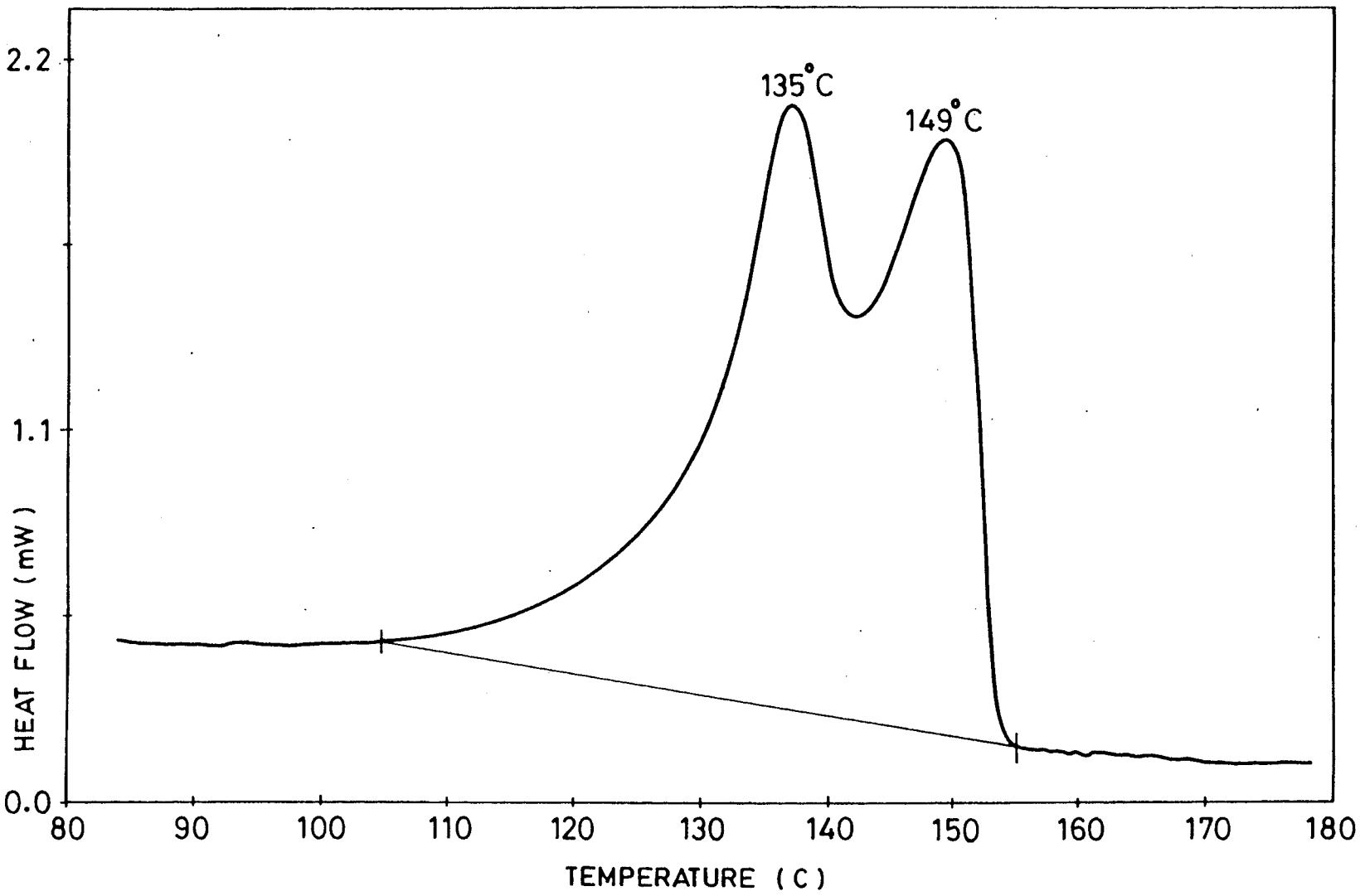
FIG. 1 is a graph showing the peak of melting of a low-molecular olefin copolymer (A) used in an Example 1 of the toner production process in accordance with the present invention.
Figure 2:
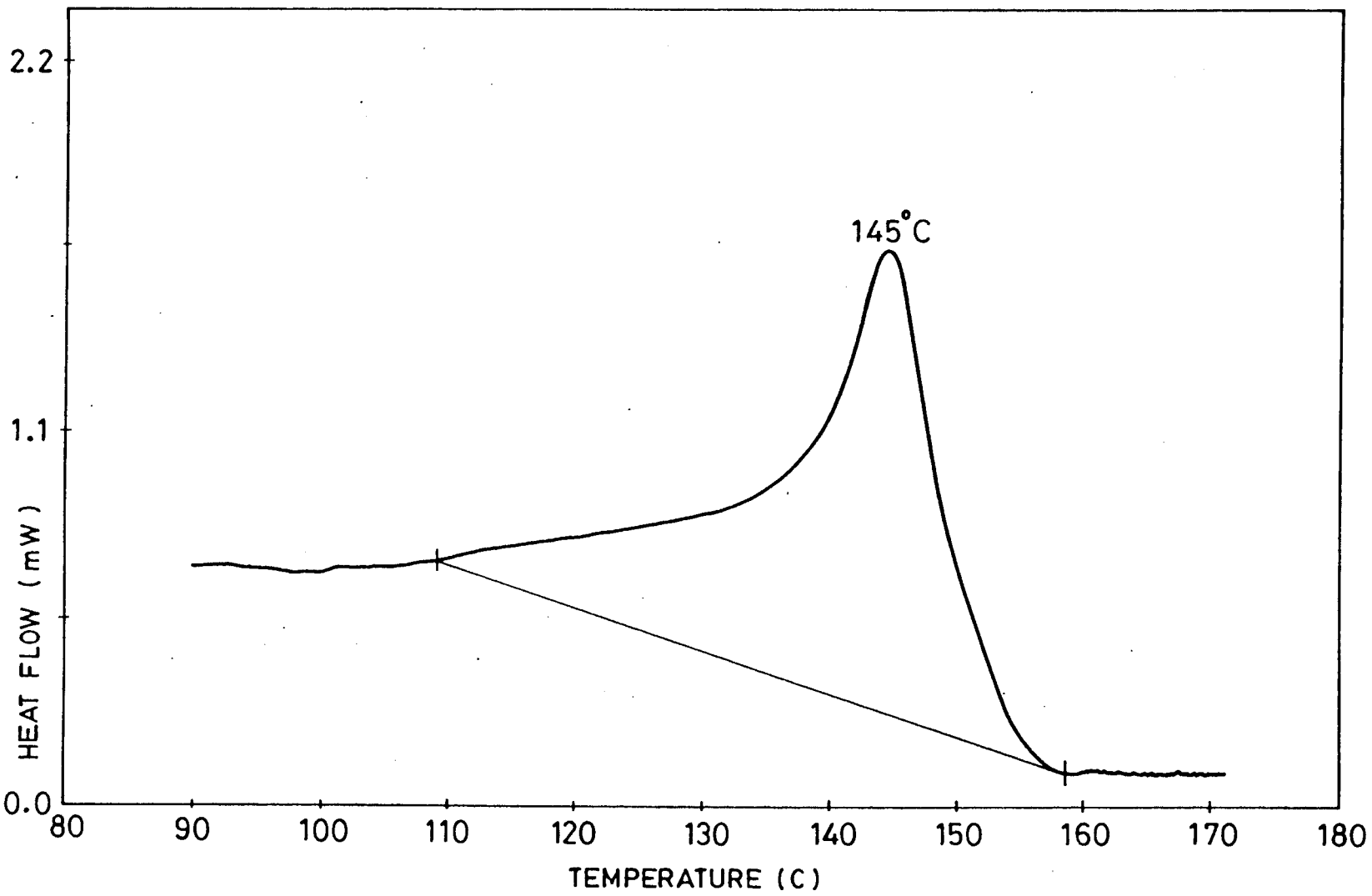
FIG. 2 is a graph showing the peak of melting of polypropylene used in a Comparison Example.

Toners can be produced by various methods. For instance, a pulverizing method employs a step of dispersing a specific low-molecular olefin copolymer in a binding resin, in which the binding resin and the specific low-molecular olefin copolymer are molten at a temperature higher than the softening points or melting points of the binding resin and the specific low-molecular olefin copolymer. The copolymer and binding resin are blended together followed by cooling to room temperature. Pulverization and classification of the resulting particles are then conducted.

In the present invention, when the specific low-molecular olefin copolymer has two or more peaks of melting, it is considered that the specific low-molecular olefin copolymer has quite a unique construction in the binding resin.

During the cooling of the specific low-molecular olefin copolymer, the components of the higher melting peak closer to the melting point form numerous nuclei in the rapid cooling phase and, in a subsequent slow cooling phase, the components of the melting peak of lower temperature form soft segments around the nuclei. The soft segments are considered to be formed of random-copolymerized portions. Thus, it is considered that the low-molecular polyolefin copolymer exists in the form of dual structure particles, each being composed of a core portion of a hard segment and an outer shell portion of a soft segment.

Thus, the specific low-molecular polyolefin copolymer particles exist in an extremely small amount and in a highly dispersed state. The core-shell dual structure of particles, composed of a core hard segment and a shell portion of soft segment which firmly attaches to the core without flowing, offers a highly slippery toner particle which exhibits reduced tendency for damaging and grinding of the surface of the photosensitive member.

The low-molecular olefin copolymer used in the present invention may be such one that contains at least two alternating repeating units formed by additive copolymerizing at least two monomers selected from a group consisting of straight chain α-olefins such as ethylene, propylene, butene-1, pentene-1, hexene-1, heptene-1, octene-1 nonene-1 and decene-1, branched-chain α-olefins expressed by a general formula $CH_2{=}CH{-}(CH_2)_n{-}CH(CH_3)_2$ or $CH_2{=}CH{-}(CH_2)_n{-}C(CH_3)_3$ and olefins having different positions of unsaturated groups of these olefins. It is also possible to use olefin copolymers which are formed by preparing a high-molecular olefin copolymer and cutting the main chains of the polymer so as to form the olefin copolymer of reduced molecular weight.

For instance, the following materials are listed as suitable examples of the low-molecular olefin copolymer having at least two olefin monomer repeating units as used in the present invention: copolymers such as propylene-ethylene copolymer, ethylene-butene copolymer, propylene-butene copolymer, propylene-pentene copolymer, propylene-4-methyl pentene-1 copolymer; propylene-ethylene-butene ternary copolymer; and denatured products of these copolymers. Among these materials, the propylenic copolymers, such as propylene-ethylene copolymer, propylene-ethylene-butene terpolymer and their denatured products are used, preferably.

From the view point of anti-offset characteristic, dispersion in the binding resin and anti-blocking characteristic, it is more preferred to use a low-molecular olefin copolymer which has a propylene content of 85 to 99.5 wt %.

An example of denaturing a low-molecular olefin copolymer is to heat and knead the low-molecular olefin copolymer by a suitable means such as a melting/kneading machine so as to cut the polymer main chains of the low-molecular olefin copolymer. In order to realize two peaks of melting, it is preferred that the olefin copolymer is treated for 0.5 to 20 minutes, preferably 0.5 to 10 minutes, at a treating temperature of 180° to 300° C., preferably 200° to 250° C., at a speed of 100 to 300 rpm.

The low-molecular olefin copolymer used in the invention preferably has two peaks of melting in a temperature range between 90° C. and 170° C. It is more preferred that two peaks of melting appear in a range between 115° C. and 160° C. It is possible to realize two or more peaks of melting by suitably selecting the composition ratio of the two or more monomers and the denaturing conditions. The lubricating effect of the toner particle surface attained by the dual structure of the particles, as well as the minute and good distribution of the low-molecular olefin copolymer, cannot be attained if the low-molecular olefin copolymer has only one peak of melting.

When the melting peaks appear at temperatures above 170° C., the low-molecular polyolefin copolymer cannot be sufficiently molten in the binding resin, thus exhibiting inferior dispersion. In general, substances having a peak of melting at higher temperatures have greater hardness at the time of crystallization, and therefore fail to meet the demand for prevention of grinding and damaging of the photosensitive member aimed at by the present invention.

When a peak of melting appears at a temperature below 90° C., there is a risk that the toner particles will fuse to each other or deposit on the photosensitive member, as the toner particles may be molten by the heat produced as a result of frictional contact between the photosensitive member and the cleaning member. In order to realize the rapid cooling effect which is preferred for the purpose of refining and dispersion of the low-molecular olefin copolymer, it is preferred that the highest melting peak temperature ranges between 130° and 170° C. The second melting peak temperature is lower than the highest melting peak temperature by at least 5° C., preferably by 10° C. or more.

The specific low-molecular olefin copolymer used in the present invention has a weight average molecular weight which preferably ranges between 1,000 and 15,000, more preferably between 2,000 and 10,000. When the weight average molecular weight is large, the low-molecular olefin particles in the toner have large sizes. Problems are caused when such large particles have abraded from the toner surface. For instance, if the toner is of positive charge type, the abraded low-molecular polyolefin particles together with a small number of toner particles are developed as if they form a group of negative particles due to the negative characteristic of these large particles, resulting in a fogging of the developed image.

On the other hand, an unduly low molecular weight of the low-molecular olefin copolymer makes the polyolefin fragile, making it difficult to achieve the object of the invention.

The peak of melting in the invention was measured by the following method, using a differential scanning calorimeter (DSC). Samples were weighed in amount of about 10 to 20 mg and set in cells. The samples were once heated up to 180° C. and held at this temperature for 10 minutes, followed by cooling to 80° C. at a rate of 10° C./min. Then, the measurement was conducted while heating the samples again at a rate of 10° C./min.

Various methods are available for measuring the weight average molecular weight, and the measuring result slightly fluctuates according to the measuring method selected. In the invention, therefore, the weight average molecular weight was measured by the following method.

The molecular weight measurement was conducted by using gel permeation chromatography (GPC). The measurement was conducted at a measuring temperature of 135° C. by pouring 400 μl of sample of 0.1 wt % density at a measuring flow rate of 1.0 ml/min, by using ortho-dichlorobenzene (with addition of 0.1% of phenol type antioxidant) as the solvent. The measurement of the molecular weight of the sample was conducted by using a calibration curve formed by using a monodispersion polystyrene as the standard sample. The column may be, for example, Shadex A-80M.

Preferably, the toner of the present invention contains 0.5 to 10 weight parts, preferably 1 to 7 weight parts, of low-molecular olefin copolymer per 100 weight parts of binder resin. The low-molecular olefin copolymer cannot produce any appreciable effect when its content is below 0.5 parts by weight. Conversely, when the content exceeds 10 parts by weight, it is difficult to disperse the low-molecular polyolefin copolymer uniformly in the binding resin, resulting in a reduction of the anti-blocking characteristic of the toner.

The binding resin used in the toner of the invention can be formed from the following monomers: styrenes, such as styrene, α-methyl styrene, p-methyl styrene, p-chloro styrene and vinyl toluene, as well as their substitutes; acrylic acid esters such as methyl acrylate, ethyl acrylate, n-butyl acrylate and t-butyl acrylate; methacrylic acid esters such as methyl methacrylate, ethyl methacrylate, n-butyl methacrylate, t-butyl methacrylate, 2-ethylhexyl methacrylate, and cyclohexyl methacrylate; acrylonitrile; vinyl ethers such as vinylmethyl ether and vinylethyl ether; unsaturated carboxylic acids and their esters such as maleic acid and maleic acid ester; olefins such as ethylene, propylene and butadiene; diolefins; and so forth. Homopolymers of these monomers and copolymers having two or more of these monomers can suitably be used as the binding resin. It is also possible to use, as the binding resin, polyester, crosslinked polyester, polyether, polyamide, epoxy resin, polyamide, terpene resin and phenol resin independently or in the form of a mixture.

The polymerization of the aforesaid monomers may be conducted by using, as a crosslinking agent, a compound having two or more polymerizable double bonds. Examples of such a crosslinking agent are: aromatic divinyl compounds such as divinyl benzene and divinyl naphthalene; carboxylic acid esters having two or more double bonds such as ethylene glycol diacrylate, triethylene glycol diacrylate and bisphenol diethylene glycol diacrylate; vinyl compounds such as divinyl ether, divinyl sulfide and divinyl sulfone; and compounds having three or more vinyl groups. These substances may be used independently or in the form of a mixture.

Among the aforementioned materials of the binding resin, crosslinked styrene-acrylate ester type copolymers, crosslinked styrene-methacrylate ester type copolymers and crosslinked polyester resins are used most suitably from the view points of anti-offset characteristic, durability and affinity to the specific low-molecular olefin copolymer.

The toner of the present invention can contain, as desired, various additives which are added for the purposes of charge control, coloring, color control or fluidizing. Examples of such additives are carbon black, dyestuffs and pigments, metal complexes, hydrophobic colloidal fine powder of silica, plasticizer and polyvinylidene fluoride powder. It is also possible to add a non-magnetic inorganic fine powder for the purpose of removing deposits from the photosensitive member. Examples of such non-magnetic inorganic fine powder are alumina, titanium dioxide, barium titanate, magnesium titanate, strontium titanate and zinc oxide.

The toner of the present invention can contain magnetic powder as required. The magnetic powder is formed of a substance which can be magnetized when placed in a magnetic field. Examples of the magnetic powder are powders of ferromagnetic metals such as iron, cobalt and nickel, as well as their alloys, and compounds such as magnetite, $\alpha$-$Fe_2O_3$ and ferrite. In order to attain the aforementioned effect of the present invention, the magnetic powder preferably has a BET specific surface area of 1 to 20 $m^2/g$, particularly 2.5 to 12 $m^2/g$, as measured by nitrogen absorption method and Moh's hardness of 5 to 7. Preferably, the content of the magnetic powder ranges between 10 and 70 wt % with respect to the total weight of the toner.

The toner of the present invention can be prepared by various processes. For example, a toner production process employs blending and kneading of material by a heat-kneading machine such as a heat roll, a kneader or an extruder, followed by mechanical pulverization and classification. In another process, predetermined materials are dispersed in a solution of a binding resin and the thus formed solution is atomized and dried to form solid particles. In still another process, predetermined materials are mixed in monomers which are to form the binding resin so as to form an emulsified suspension and the suspension is polymerized to form the toner. Among various processes, the process employing the heat-kneading, pulverization and classification is used most suitably.

Examples of the process for preparing the low-molecular polyolefin copolymer are shown below.

SYNTHESIS EXAMPLE 1

A propylene-ethylene copolymer, containing 15 wt % of ethylene and having a weight average molecular weight of 4500 with a peak of melting appearing at 160° C. was used as the starting material, A twin kneader was heated to a temperature of about 230° C. and operated at a rotor speed of 180 rpm so as to knead the material in an open-vent mode. The period of processing of the propylene-ethylene copolymer in the kneader was about 2 minutes. The strand discharged from the kneader was cooled and pelletized by a cutter and further pulverized into a powder by means of a pulverizing machine. The low-molecular olefin copolymer (A) thus obtained exhibited peaks of melting at 149° C. and 135° C., as well as a weight average molecular weight of 4500.

SYNTHESIS EXAMPLES 2-6

Low-molecular olefin copolymers (B) to (F) were prepared by the same process as Synthesis Example 1, while using various olefin copolymers shown in Table 1 in place of the propylene-ethylene copolymer. All these copolymers (B) to (F) showed two or more peaks of melting as shown in Table 1.

TABLE 1

| Example of synthesis | Low-molecular olefin copolymer | Composition monomer | Composition ratio | Material polymer Melt peak | Low-molecular olefin copolymer Melt peak 1 | Melt peak 2 | Melt peak 3 | Mean molecular weight |
|---|---|---|---|---|---|---|---|---|
| 1 | A | propylene-ethylene | 85/15 | 160° C. | 149° C. | 135° C. | — | 4500 |
| 2 | B | propylene-ethylene | 95/5 | 185 | 165 | 150 | — | 9000 |
| 3 | C | propylene-ethylene-butene-1 | 85/5/10 | 145 | 135 | 120 | — | 2100 |
| 4 | D | propylene-butene-1 | 85/15 | 110 | 105 | 92 | — | 9800 |
| 5 | E | propylene-ethylene-butene-1 | 90/5/5 | 160 | 160 | 146 | 129° C. | 1800 |
| 6 | F | propylene-4 methylpentene-1 | 95/5 | 145 | 131 | 115 | — | 12500 |

In the following description of Examples of the toner in accordance with the present invention, the contents of various components are expressed in terms of parts by weight.

EXAMPLE 1

A blend was formed by mixing 100 parts of styrene-2-ethylhexyl acrylate-divinyl benzene copolymer (weight average molecular weight 350,000), 4 parts of nigrosine, 60 parts of a magnetic powder and 5 parts of the low-molecular polyolefin copolymer (A) as obtained in Synthesis Example 1. The blend was molten and kneaded by a twin-type kneading machine at 180° C. and was then cooled in contact with a cooling conveyor the temperature of which was set at 10° to 30° C. Subsequently, the cooled material was coarsely crushed by a hammer mill and then finely pulverized by means of a jet pulverizing machine. Then, classification was conducted by means of an air classifier, so that black toner powder of a volume average particle size of about 11 μm was obtained.

Then, 0.5 part of hydrophobic colloidal silica was added to 100 parts of the back toner particles and the mixture was blended by a Henschel mixer, whereby toner particles having hydrophobic colloidal silica on the surface of the toner particles were obtained.

The toner was subjected to measurement of peaks of melting conducted with a differential scanning calorimeter. Two peaks of melting were obtained substantially at the same temperatures as those of the low-molecular olefin copolymer (A).

Images were formed with this toner on a commercially available copying machine NP-3525. Images of a high image density of 1.32 were obtained at a high resolution without any fog. The copying machine employed in the test had photosensitive drum with a laminate type OPC (organic photoconductive) member as a photosensitive layer, and a cleaning blade for cleaning the surface of the photosensitive drum. In order to examine the durability, 30,000 copies were produced. The amount of grinding of the photosensitive layer was as small as 0.8 μm and no substantial damage was found on the surface of the photosensitive drum. Thus, a clear copy image could be obtained even after this durability test operation.

EXAMPLE 2

A toner was prepared substantially by the same process as Example 1, except that the mixture used as the starting material contained 100 parts of crosslinked polyester resin (weight average molecular weight about 100,000), 3 parts of chromium complex organic compound, 50 parts of magnetic powder and 4 parts of the low-molecular olefin copolymer (B) of the Synthesis Example 2. Measurement of the peaks of melting conducted by means of a differential scanning calorimeter proved that this toner had two peaks of melting substantially at the same temperatures as those of the low-molecular olefin copolymer (B).

Image-forming test operations were conducted by using this toner on a commercially available laser beam printer LBP-CX Clear images with high image density of 1.29 were obtained without any fog. The laser beam printer used in the test had a photosensitive drum with a laminate type OPC member as a photosensitive layer, and a cleaning blade for cleaning the surface of the photosensitive drum.

EXAMPLES 3-7

Toners were prepared substantially by the same process as Example 1, except that the low-molecular olefin copolymers (B) to (F) were used in place of the low-molecular olefin copolymer (A). These toners were subjected to measurement of peaks of melting by the differential scanning calorimeter and, as a result, it was confirmed that each of these toners had two or more peaks substantially at the same temperature levels as the low-molecular olefin copolymer contained therein.

Image-forming test operations were carried out using these toners in the same manner as Example 1, the results being shown in Table 2.

It will be seen that no damaging of the laminate type OPC member was observed and the amounts of grinding of the laminate type OPC layer were slight in all cases.

The low-molecular olefin copolymer contained in the moderate-size portion (usable as the toner) and fine particle portion separated by classification were quantitatively analyzed. As will be seen from Table 2, the low-molecular olefin copolymer was uniformly dispersed without any local concentration.

TABLE 2

| Example No. | Image density | Fogging | Grinding of photosensitive member | Low-molecular olefin copolymer content wt % | |
|---|---|---|---|---|---|
| | | | | Toner | Fine particles |
| 1 | 1.32 | No fog. | 0.8 | 3.0 | 3.2 |
| 2 | 1.29 | No fog. | 0.2 | 2.5 | 2.6 |
| 3 | 1.30 | No fog. | 0.7 | 3.0 | 3.1 |
| 4 | 1.31 | No fog. | 0.8 | 3.1 | 3.3 |
| 5 | 1.28 | No fog. | 0.6 | 2.9 | 3.3 |
| 6 | 1.33 | No fog. | 0.7 | 3.1 | 3.1 |
| 7 | 1.32 | No fog. | 0.9 | 3.0 | 3.2 |

EXAMPLE 8

Toner was prepared by the same method as in Example 1. Fine particles and coarse particles separated through classification were collected and 35 parts of such collected particles were added to the same starting material as Example 1, followed by kneading and pulverization. This process was repeated five times so that a toner of a volume average particle size of about 11 μm was obtained.

To 10 parts of this toner was added 0.5 part of hydrophobic colloidal silica. The mixture was blended by a Henschel mixer so that a toner having hydrophobic colloidal silica was obtained.

Temperatures of peaks of melting of the thus obtained toner were measured by means of the differential scanning calorimeter. As a result, two peaks of melting were observed at temperatures substantially the same as those of melting peaks of the low-molecular olefin copolymer (A). Quantitative analysis of the toners showed that the toner of the first generation, i.e., the toner after the first cycle of toner preparation, contained 3.0 wt % of the low-molecular olefin copolymer, while the toner of the fifth generation, i.e., the toner after the fifth cycle of toner preparation, contained 3.1 wt % of the low-molecular olefin copolymer.

These toners were subjected to the same evaluation as that conducted for the toner of Example 1. High image density of 1.31 and clear image without any fog were confirmed. The quality of the copy image was stable even after production of 30,000 copies for durability test operation. The grinding of the laminate type OPC photosensitive layer was as small as 0.8 μm.

COMPARISON EXAMPLE 1

A low-molecular polypropylene was prepared using a propylene homopolymer in the same manner as Synthesis Example 1. The low-molecular polypropylene had a peak of melting at 145° C. and a weight average molecular weight of 3,000.

A toner was prepared by the same method as in Example 1, except that this low-molecular weight polypropylene was used, and the same test as Example 1 was conducted with this toner. The moderate-size particle portion (used as the toner) and the fine-sized particle portion which were separated through classification and contained 25. wt % and 3.6 wt % of the low-molecular polypropylene, respectively, thus proving the tendency of uneven presence of the low-molecular polypropylene. After the durability test production of 30,000 copies, a large grinding of 3.5 μm of the laminate-type OPC layer was observed. In addition, many circumferential scratches were formed in the surface of the laminate type OPC photosensitive layer. Thus, the copy image was roughened and score-like defects were formed in the copy image to degrade the image quality, after the durability test operation for producing 30,000 copies. From this fact, it is understood that the formation of the specific toner particle construction offered by the use of the low-molecular olefin copolymers is a critical and essential feature of the invention of this application.

COMPARISON EXAMPLE 2

A toner was prepared by the same method as Example 1, except that a propylene-ethylene copolymer (ethylene content 2%) having a weight average molecular weight of 5,500 and exhibiting melting peaks at 185° C. and 167° C. was used and that the kneading was conducted as 190° C. The thus prepared toner was tested by the same method as in Example 1.

A large grinding amount of 2.7 μm of the photosensitive layer was observed after production of 30,000 copies. Scratches were also found in the surface of the photosensitive layer. It appears that the toner of this comparison example cannot produce the expected effect of the invention, because of the reduced effect of the copolymer.

COMPARISON EXAMPLE 3

A toner was prepared by the same method as Example 1, using a propylene-butene-l copolymer having a weight average molecular weight of 2,600 and exhibiting peaks of melting at 98° C. and 79° C. The thus prepared toner was subjected to the same test as Example 1.

The amount of grinding of the photosensitive layer observed after the durability test production of 30,000 copies was not so large, i.e., 0.7 μm, but the toner exhibited increased tendency of sticking to the cleaning blade. In addition, the surface of the photosensitive layer was locally damaged. Moreover, toner deposited as a film on the surface of the photosensitive member. In consequence, the image density was reduced from 1.31 to 1.08, after the durability test.

COMPARISON EXAMPLE 4

A toner was prepared by the same method as Example 1 except that the low-molecular olefin copolymer was omitted, and the thus prepared toner was tested in the same manner as Example 1.

After the durability test production of 30,000 copies, a large grinding amount of 3.4 μm was observed on the photosensitive member. In consequence, the quality image was made rougher after the durability test.

COMPARISON EXAMPLE 5

A toner was prepared and tested in the same manner as Example 1, except that a propylene-butene-l copolymer having a weight average molecular weight of 7,700 and exhibiting only one peak of melting at 128° C. was used.

In this Example, fogging was seriously observed and the density was reduced from 1.28 to 1.20 after the durability test. This seems to be attributable to the fact that the charges carried by the toner particles are not uniform due to insufficient dispersion of the toner particles as a result of difficulty in formation of initial fine nuclei because of the presence of only one peak of melting.

COMPARISON EXAMPLE 6

A toner was prepared by the same method as Example 8 except that the low-molecular propylene homopolymer used in Comparison Example 1 was used. As a result of a quantitative analysis, it was confirmed that the toner of the first generation contained 2.5 wt % of the low-molecular polypropylene, while the toner of the fifth generation contained 4.9 wt % of the low-molecular weight polypropylene. The toner contained numerous free low-molecular polyolefin particles of negative charging characteristic, surrounded by toner particles of positive charging characteristic. The groups of such particles could not be charged sufficiently so that they were reproduced as fog components, thus degrading the quality of the copied image.

As has been described, the toner of the present invention contains a low-molecular olefin copolymer having two or more peaks of melting at temperatures ranging between 90° and 170° C. so as to ensure a constant stability of image density and image quality, while effectively suppressing damaging and grinding of the surface of the photosensitive member.

What is claimed is:

1. A toner for developing electrostatic latent images, comprising a binding resin and a low-molecular weight olefin copolymer, said low-molecular weight olefin copolymer having at least two olefin monomer repeating units and having two or more peaks of melting at temperatures ranging between 90° C. and 170° C.

2. A toner according to claim 1, wherein said low-molecular weight olefin copolymer comprises a low-molecular weight propylenic copolymer.

3. A toner according to claim 3, wherein said low-molecular weight olefin copolymer comprises a propylenic copolymer selected from the group consisting of a low-molecular weight propylene-ethylene copolymer, a low-molecular weight propylene-butene copolymer, a low-molecular weight propylene-pentene copolymer, a low-molecular weight propylene-4-methylpentene-l copolymer, and a low-molecular weight propylene-ethylene-butene copolymer.

4. A toner according to claim 2, wherein said low-molecular weight propylenic copolymer has an olefin content of 85 to 99.5 wt %.

5. A toner according to claim 1, wherein said low-molecular weight olefin copolymer has two or more peaks of melting at temperatures between 115° C. and 160° C.

6. A toner according to claim 1, wherein said low-molecular weight olefin copolymer has a weight average molecular weight between 1,000 and 15,000.

7. A toner according to claim 1, wherein said low-molecular weight olefin copolymer has a weight average molecular weight between 2,000 and 10,000.

8. A toner according to claim 1, wherein said low-molecular weight olefin copolymer is present in amounts from 0.5 to 10 parts by weight per 100 parts by weight of said binding resin.

9. A toner according to claim 1, wherein said low-molecular weight olefin copolymer is present in amounts from 1 to 7 parts by weight per 100 parts by weight of said binding resin.

10. A toner according to claim 1, wherein said binding resin comprises a crosslinked styrene-acrylate ester type copolymer.

11. A toner according to claim 1, wherein said binding resin comprises a crosslinked styrene-methacrylate ester type copolymer.

12. A toner according to claim 1, wherein said binding resin comprises a crosslinked polyester resin.

13. A toner according to claim 1, wherein said low-molecular olefin copolymer has been subjected to a heat treatment conducted at 180° to 300° C. for 0.5 to 20 minutes.

14. A toner according to claim 1, wherein said low-molecular olefin copolymer has been subjected to a heat treatment conducted at 200° to 250° C. for 0.5 to 10 minutes.

15. A toner according to claim 1, wherein 100 parts by weight of said binding resin comprising crosslinked styrene-acrylate ester type copolymer and 1 to 7 parts by weight of low-molecular weight propylene-ethylene copolymer are present, said low-molecular weight propylene-ethylene copolymer having been subjected to a heat treatment conducted at 180° to 300° C. for 0.5 to 20 minutes and having a weigh average molecular weight of 2,000 to 10,000.

16. A toner according to claim 1, wherein 100 parts by weight of said binding resin comprising crosslinked styrene-methacrylate ester type copolymer and 1 to 7 parts by weight of low-molecular weight propylene-ethylene copolymer are present, said low-molecular weight propylene-ethylene copolymer having been subjected to a heat treatment conducted at 180° to 300° C. for 0.5 to 20 minutes and having a weight average molecular weight of 2,000 to 10,000.

17. A toner according to claim 1, wherein 100 parts by weight of said binding resin comprising crosslinked polyester resin and 1 to 7 parts by weight of low-molecular weight propylene-ethylene copolymer are present, said low-molecular weight propylene-ethylene copolymer having been subjected to a heat treatment conducted at 180° to 300° C. for 0.5 to 20 minutes and having a weight average molecular weight of 2,000 to 10,000.

* * * * *